US012276441B2

(12) United States Patent
Bae et al.

(10) Patent No.: US 12,276,441 B2
(45) Date of Patent: Apr. 15, 2025

(54) WATER HEATER AND CONTROL METHOD THEREFOR

(71) Applicant: LG ELECTRONICS INC., Seoul (KR)

(72) Inventors: Yose Bae, Seoul (KR); Minsu Kim, Seoul (KR); Hyewon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 333 days.

(21) Appl. No.: 16/829,569

(22) Filed: Mar. 25, 2020

(65) Prior Publication Data

US 2021/0239328 A1 Aug. 5, 2021

(30) Foreign Application Priority Data

Jan. 31, 2020 (KR) ..... 10-2020-0011980

(51) Int. Cl.
*F24D 19/10* (2006.01)
*F24D 17/00* (2022.01)
(Continued)

(52) U.S. Cl.
CPC ..... *F24H 9/2021* (2013.01); *F24D 17/0036* (2013.01); *F24D 17/02* (2013.01);
(Continued)

(58) Field of Classification Search
None
See application file for complete search history.

(56) References Cited

U.S. PATENT DOCUMENTS 5,255,338 A * 10/1993 Robinson, Jr. ..... F24D 19/1054 219/510
2010/0209084 A1* 8/2010 Nelson ..... F24H 4/04 62/238.7
(Continued)

FOREIGN PATENT DOCUMENTS

JP 2005-283024 A 10/2005
JP 2008-241114 A 10/2008
(Continued)

OTHER PUBLICATIONS

Korean Office Action dated Jan. 19, 2021 issued in Application 10-2020-0011980.
(Continued)

*Primary Examiner* — Steven B McAllister
*Assistant Examiner* — John E Bargero
(74) *Attorney, Agent, or Firm* — KED & ASSOCIATES, LLP

(57) ABSTRACT

A water heater is provided that heats water in a storage tank and discharges the heated water. The water heater includes a storage tank configured to store water, at least one first temperature sensor configured to sense a temperature of the water stored in the storage tank, a second temperature sensor configured to sense a temperature related to an outside of the water heater, a first heat exchanger comprising at least one heating element configured to heat the water, a second heat exchanger comprising a heat pump system and configured to heat the water, and a controller configured to control at least one of the first heat exchanger and the second heat exchanger based on a temperature sensed by the second temperature sensor and a set water temperature.

16 Claims, 7 Drawing Sheets

(51) Int. Cl.

| | |
|---|---|
| ***F24D 17/02*** | (2006.01) |
| ***F24H 1/18*** | (2022.01) |
| ***F24H 1/20*** | (2022.01) |
| ***F24H 9/20*** | (2022.01) |
| ***F24H 15/174*** | (2022.01) |
| ***F24H 15/225*** | (2022.01) |
| ***F24H 15/258*** | (2022.01) |
| ***F24H 15/37*** | (2022.01) |
| ***F24H 15/375*** | (2022.01) |
| ***F24H 15/414*** | (2022.01) |
| *F24H 15/128* | (2022.01) |
| *F24H 15/136* | (2022.01) |
| *F24H 15/281* | (2022.01) |

(52) U.S. Cl.

CPC ..... *F24D 19/1054* (2013.01); *F24H 1/18* (2013.01); *F24H 1/202* (2013.01); *F24H 15/174* (2022.01); *F24H 15/225* (2022.01); *F24H 15/258* (2022.01); *F24H 15/37* (2022.01); *F24H 15/375* (2022.01); *F24H 15/414* (2022.01); *F24D 2200/123* (2013.01); *F24D 2200/32* (2013.01); *F24H 15/128* (2022.01); *F24H 15/136* (2022.01); *F24H 15/281* (2022.01); *F24H 2250/02* (2013.01)

(56) References Cited

U.S. PATENT DOCUMENTS

| | | | | |
|---|---|---|---|---|
| 2013/0145786 | A1* | 2/2013 | Tamaki et al. ..... | F24H 19/1051 62/161 |
| 2014/0037275 | A1* | 2/2014 | Flohr ..... | H02J 3/14 392/464 |
| 2014/0161430 | A1 | 6/2014 | Roetker et al. | |
| 2016/0069574 | A1 | 3/2016 | Tsai | |
| 2019/0128565 | A1 | 5/2019 | Pugh et al. | |

FOREIGN PATENT DOCUMENTS

| | | |
|---|---|---|
| JP | 2018-119723 A | 8/2018 |
| KR | 10-1780071 | 9/2017 |

OTHER PUBLICATIONS

Extended European Search Report dated Feb. 2, 2021 issued in Application 20189510.9.

* cited by examiner

WATER HEATER AND CONTROL METHOD THEREFOR

CROSS-REFERENCE TO RELATED APPLICATION

This application claims the benefit of Korean Patent Application No. 10-2020-0011980, filed in Korea on Jan. 31, 2020, in the Korean Intellectual Property Office, the disclosure of which is incorporated herein in its entirety by reference.

BACKGROUND

1. Field

The present disclosure relates to a water heater, and one particular embodiment relates to a control method for controlling an operation of a water heater in consideration of an outdoor temperature and a set water temperature.

2. Background

In general, a water heater is an electronic appliance for heating liquid such as water and employees a scheme of transmitting resistive heat of a heater to a storage tank containing content such as water or other liquid to be heated by attaching the heater to an outer wall of the storage tank, or a scheme of heating water or other liquid by providing a heater in a storage tank to be in direct contact with the water or other liquid. However, the aforementioned schemes have a problem in that it could be highly in danger unless an adequate safety device is equipped therewith because a maximum temperature is about 800° C., and a problem in that power consumption is required due to use of a resistive heater. For this reason, a technology related to a water heater using a heat pump has been studied.

Korea Patent No. 10-1780071B1 (registered on Sep. 13, 2017), the subject matter of which is incorporated herein by reference, relates to a device for providing hot water in conjunction with a heat pump, the device which provides hot water using a heat pump system using a refrigerant compression cycle. Specifically, Korean Patent No. 10-1780071B1 relates to a device for detecting a temperature and a flow rate of a refrigerant and comparing the detected temperature and the detected flow rate with a reference temperature and a reference flow rate to control an operation of a water heater. However, Korean Patent No. 10-1780071B1 discloses merely a feature of controlling the operation of the water heater by detecting the temperature and the flow rate of the refrigerant, and does not disclose a feature of controlling the operation of the water heater in consideration of an outdoor temperature and a set temperature.

Therefore, there is a need for a technique for controlling the operation of the water heater in consideration of an outdoor temperature and a set temperature.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
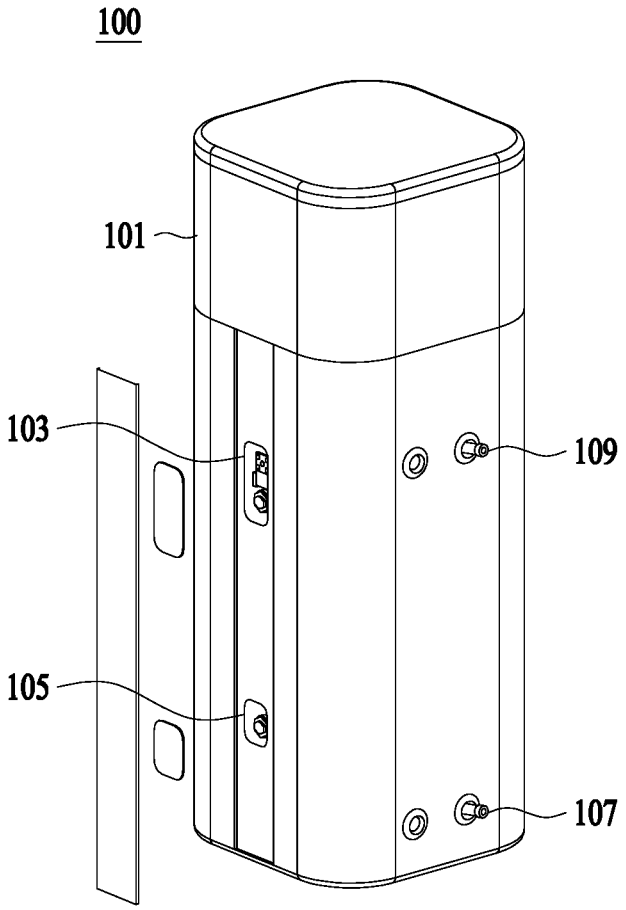
FIG. 1 is an external perspective view of a water heater according to an embodiment of the present disclosure.
Figure 2:
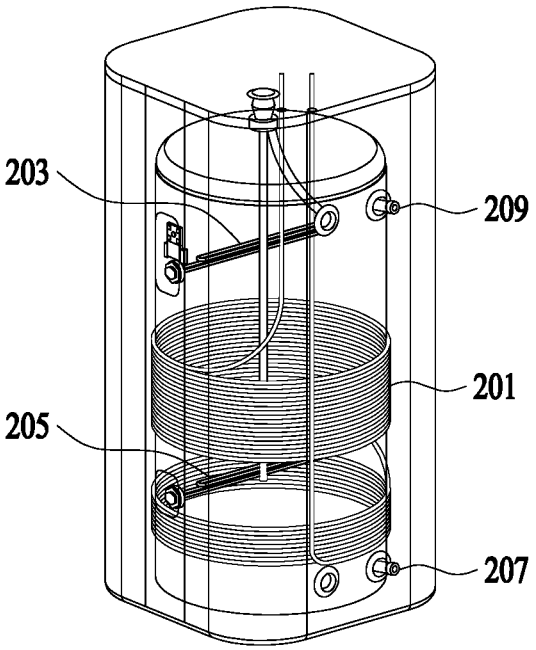
FIG. 2 is a diagram illustrating an inside of a water heater according to an embodiment of the present disclosure.

FIG. 1 is an external perspective view of a water heater according to an embodiment of the present disclosure. FIG. 2 is a diagram illustrating an interior of a water heater according to an embodiment of the present disclosure.

FIG. 1 illustrates an exterior of a water heater, and FIG. 2 illustrates transparency of the water heater. A water heater 100 may provide a user with water by heating the water stored in a storage tank or by maintaining a temperature of the water stored in the storage tank. In this case, the water heater 100 may use at least one of a first heat exchanger and a second heat exchanger to heat the water stored in the storage tank or to maintain a temperature of the water. The water heater 100 may heat the water, supplied to the storage tank through water inlet pipes 107 and 207, using at least one of the first heat exchanger and the second heat exchanger, and may discharge water, heated up to a set temperature, through water outlet pipes 109 and 209.

The first heat exchanger is a device including a heating element that generates heat according to the application of power to heat water. For example, the first heat exchanger may include at least one heater, and the heater may include an electric resistive heater. The first heat exchanger may include two heaters 103 and 105 as shown in FIG. 1, but this is merely an example and the scope of the present disclosure is not limited to the two heaters 103 and 105. Here, the heater 103 and 203 may be an upper heater, and the heater 105 and 205 may be a lower heater disposed below the upper heater. The heating element may be made of a conductive and rigid material (e.g., stainless steel). A substance capable of generating heat according to an electrical connection may be included in the heating element. An example of the heating element may include a nichrome wire in a coil shape. An example of such heaters 103 and 105 may include a sheath heater.

The first heat exchanger including at least one heater 103 and 105 may heat the water while contacting the water stored in the storage tank. Thus, a heating rate of water of the first heat exchanger may be relatively higher than that of the second heat exchanger including the heat pump system 101. In this case, the second heat exchanger including the heat pump system 101 may consumes relatively less power than the first heat exchanger including the at least one heater 103 and 105. Thus, the second heat exchanger may be efficient as compared to the first heat exchanger. That is, the first heat exchanger may increase the temperature of the water quickly but require relatively more power consumption, and the second heat exchanger may increase the temperature of the water relatively slowly but require relatively less power consumption.

The heater 105 and 205, which is the heating element included in the first heat exchanger, may heat water located in a lower region of the storage tank. The heater 103 and 203 may heat water located in a relatively upper region of the storage tank. The positional relationship between the heater 103 and 203 and the heater 105 and 205 is merely an example, and the scope of the present disclosure is not limited to the positional relationship as shown in FIG. 1.

The heat pump system 101 may include at least one of a compressor, a condenser, an expansion valve, and an evaporator. The compressor of the heat pump system 101 using a refrigerant compression cycle may compress a refrigerant at a high temperature and a high pressure. The condenser may heat the water through heat exchange between a high temperature refrigerant having passed through the compressor and low temperature water. As shown in FIG. 2, a refrigerant pipe 201 connected to the condenser may be formed to surround the storage tank. The high temperature refrigerant having passed through the compressor may perform heat exchange with the low temperature water in the storage tank while flowing through the refrigerant pipe 201. Here, the connection relationship between the refrigerant pipe 201 and the storage tank as shown in FIG. 2 is merely an example, and the scope of the present disclosure is not limited to the connection relationship as shown in FIG. 2. The refrigerant having passed through the condenser may be introduced into the expansion valve. An example of the expansion valve is an Electronic Expansion Valve (EEV), in which an opening degree is adjustable within a predetermined range. Thus, the pressure of the refrigerant introduced into the expansion valve may be reduced. The refrigerant introduced into the evaporator through the expansion valve may be vaporized through heat exchange with outdoor air. As such, the heat pump system 101 for performing heat exchange with water using a refrigerant compression cycle through the compressor, the condenser, the expansion valve, and the evaporator may have a slow heating rate of water as compared with the heater 103 and 105.

The water in the storage tank may be heated using at least one of the first heat exchanger including at least one heater and the second heat exchanger including the heat pump system. In this case, whether to operate the first heat exchanger and the second heat exchanger may be determined according to an operation mode of the water heater, and an operation of a heat exchanger according to each operation mode will be described in detail below. The heat pump system 101 may be connected to an inverter, and the operation of the heat pump system 101 may be controlled based on an output frequency of the inverter. The inverter may convert DC power into AC power, provide the AC power to the compressor, and adjust the output frequency of the inverter in response to a required operating state of the compressor. In doing so, the energy efficiency of the water heater may improve.

Figure 3:
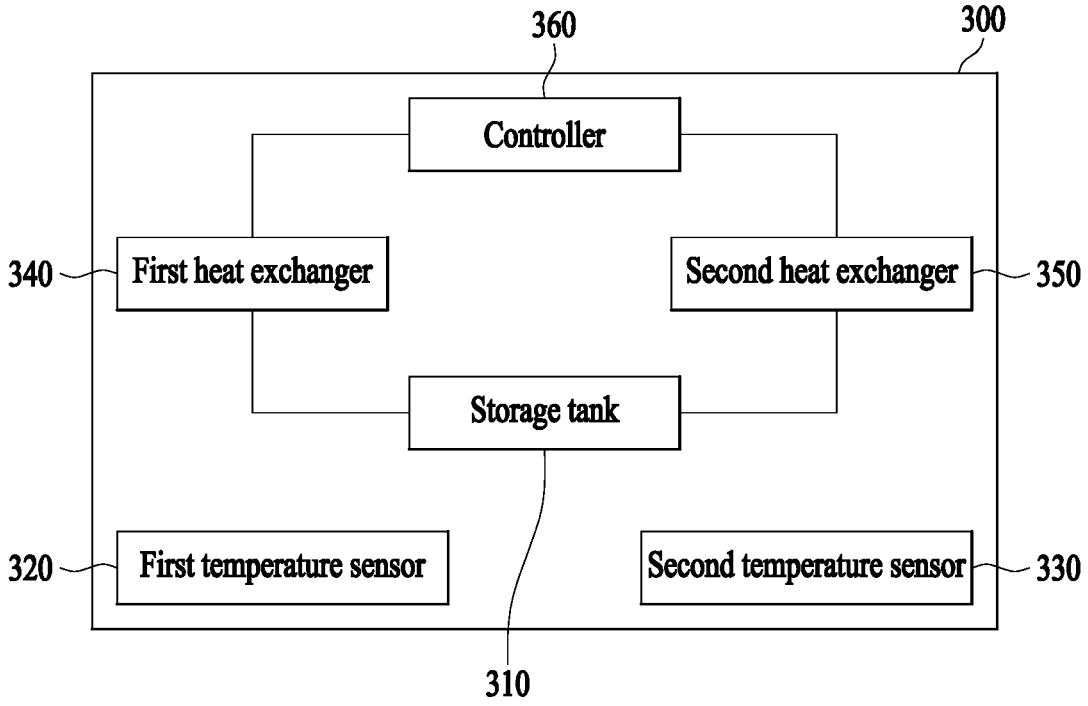
FIG. 3 is a block diagram illustrating devices included in a water heater according to an embodiment.

FIG. 3 is a block diagram illustrating devices included in a water heater according to an embodiment. The water heater 300 includes at least one of a storage tank 310, a first temperature sensor 320, a second temperature sensor 330, a first heat exchanger 340, a second heat exchanger 350, and a controller 360.

The storage tank 310 may store water. Specifically, water may be stored in the storage tank 310 through the water inlet pipes 107 and 207. In addition, the water stored in the storage tank 310 may be discharged to the outside through the water outlet pipes 109 and 209. The water discharged to the outside through the water outlet pipes 109 and 209 may be heated to a set temperature using at least one of the first heat exchanger and the second heat exchanger. The storage tank 310 may be disposed adjacent to the first heat exchanger 340 and the second heat exchanger 350. The water stored in the storage tank 310 may be heated using at least one of the first heat exchanger 340 and the second heat exchanger or may be maintained at a constant temperature.

The first temperature sensor 320 may sense a temperature of the water stored in the storage tank 310. The first temperature sensor 320 may include at least one sensor for sensing a temperature of a predetermined region inside the storage tank 310. Specifically, in a case where the inside of the storage tank 310 is divided into six regions, the first temperature sensor 320 may include six sensors respectively corresponding to the six regions. Based on a temperature sensed by each of the six sensors, the first temperature sensor 320 may sense the temperature of the water stored in the storage tank 310. The first temperature sensor 320 may sense the temperature of the water stored in the storage tank 310 in consideration of a position of each sensor, an amount of water depending on the position of each sensor, and a temperature sensed by each sensor. A more detailed description thereof will be described with reference to FIG. 5.

The second temperature sensor 330 may sense a temperature related to the outside of the water heater 300. In detail, the second temperature sensor 330 may sense an outdoor temperature related to the outside of the water heater 300.

The first heat exchanger 340 may include at least one heating element that heats water. Here, the heater 103 and 203 may be an upper heater, and the heater 105 and 205 may be a lower heater disposed below the upper heater. In the present specification, the upper heater 103 and 203 is depicted as a single heater and the lower heater 105 and 205 is depicted as a single heater, but each of the upper and lower heaters may include a plurality of heaters. Although the first heat exchanger 340 is herein described as including two heaters 203 and 205, the scope of the present specification is not limited to the first heat exchanger 340 including two heaters. The first heat exchanger 340 may heat the temperature of the water in the storage tank 310 within a relatively short period of time while consuming a relatively large amount of power.

According to an embodiment, the first heat exchanger including a plurality of heating elements may first heat a temperature of water corresponding to an upper region of the storage tank before heating a temperature of water corresponding to a lower region of the storage tank. Specifically, the first heat exchanger including two heaters 203 and 205 may first heat the temperature of the water corresponding to the upper region using the heater 203 and then heat the temperature of the water corresponding to the lower region using the heater 205. It is because there is a risk of overheating due to large power consumption if two heaters operate simultaneously. For example, in a case where the outdoor temperature is equal to or below a first temperature, the first heat exchanger may heat the temperature of the water corresponding to the upper region to a set temperature using the heater 203 and then lower the temperature of the water corresponding to the lower region to the set temperature using the heater 205.

The second heat exchanger 350 may include a heat pump system to heat the water. The heat pump system 350 using a refrigerant compression cycle may include at least one of a compressor, a condenser, an expansion valve, and an evaporator. The second heat exchanger 350 may heat the temperature of the water in the storage tank 310 in relatively slowly while consuming a relatively less amount of power.

The controller 360 may control at least one of the first heat exchanger 340 and the second heat exchanger 350 based on a temperature sensed by the second temperature sensor 330 and a set water temperature. The controller 360 may identify an outdoor temperature related to the outside of the storage tank 310, which is sensed using the second temperature sensor 330, and the controller 360 may identify the set temperature of the water. In addition, the water heater 300 may operate based on at least one of a heat pump mode, a heater mode, an auto mode, a turbo mode, and a vacation mode. The controller 360 may control at least one of the first heat exchanger 340 and the second heat exchanger 350 in response to each of the modes.

Figure 4:
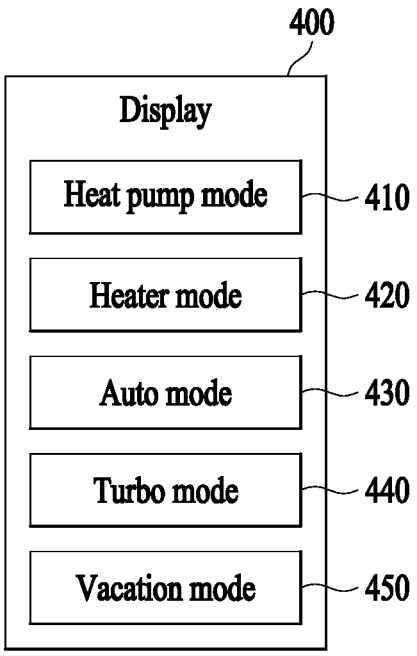
FIG. 4 is a diagram illustrating operable modes of a water heater according to an embodiment.

FIG. 4 is a diagram illustrating operable modes of a water heater according to an embodiment. The water heater may operate based on at least one of a heat pump mode 410, a heater mode 420, an auto mode 430, a turbo mode 440, and a vacation mode 450.

In a case where a temperature related to the outside of the water heater is below the first temperature, the heater may operate regardless of a mode in order to ensure reliability of the operation of the water heater. In this case, the first temperature may be a temperature that is preset through experiments. For example, in a case where the first temperature is set to 10° C., if the temperature related to the outside of the water heater is lowered to 10° C. or below, the water heater may operate using a heater regardless of a mode.

The water heater may operate based on each mode selected by the user through the display 400. In this case, a selectable mode may include a heat pump mode 410, a heater mode 420, an auto mode 430, a turbo mode 440, and a vacation mode 450.

Here, the heat pump mode 410 may correspond to a mode for heating the water in the storage tank to a set temperature using only the second heat exchanger including the heat pump system. Even in the heat pump mode 410, in a case where a temperature related to the outside of the water heater is below the first temperature, the heater may operate to prevent a failure. The heat pump mode 410 may correspond to a mode for heating water using only the second heat exchanger until the temperature related to the outside of the water heater reaches a temperature higher than the first temperature. The heat pump mode 410 may be a mode for heating water using only the heat pump system rather than the heater, the mode in which water is heated relatively slowly and very little power consumption is required.

In addition, the heater mode 420 may correspond to a mode for heating water in the storage tank to a set temperature using only the first heat exchanger including the heater. The heater mode 420 may be a mode for heating water using only the heater rather than the heat pump system, the mode in which water is heated up to a set temperature relatively quickly and a lot of power consumption is required. Thus, the heater mode 420 may be used as a mode for heating water in an environment in which the heat pump system or the inverter is inoperable or the operating efficiency is low.

In addition, in one embodiment, a user may set only a target temperature without directly determining an operation mode, and the water heater may determine an operation mode based on an outdoor temperature, a target temperature, and a current water temperature.

The auto mode 430 may correspond to a mode in which at least one of the first heat exchanger and the second heat exchanger is operated in consideration of a difference between a temperature of water stored in the storage tank and a set temperature. Specifically, in a case where the difference between the temperature of the water stored in the storage tank and the set temperature is equal to or greater than a predetermined value, the auto mode 430 may be implemented to heat the water by operating both the first heat exchanger and the second heat exchanger. In addition, in a case where the difference between the temperature of the water stored in the storage tank and the set temperature is smaller than the predetermined value, the auto mode 430 may be implemented to heat the water by operating only the heat exchanger. In the auto mode 430, the controller may operate the water heater efficiently by adjusting a frequency of the inverter in consideration of energy required to heat the water to the set temperature. For example, in a case where the predetermined value is preset to 10° C. and the difference between the temperature of the water in the storage tank and the set temperature is 8° C., the water heater set to the auto mode 430 may heat the water using only the second heat exchanger. In another example, in a case where the predetermined value is previously set at 10° C. or in a case where the difference between the temperature of the water stored in the storage tank and the set temperature is 15° C., the water heater set to the auto mode 430 may operate both the first heat exchanger and the second heat exchanger until the difference in temperature reaches 10° C. In this case, instead of setting the frequency of the inverter to the maximum to heat the water in the storage tank, the controller may adjust the frequency of the inverter in consideration of energy efficiency required to heat the water in the storage tank to the set temperature.

The turbo mode 440 may correspond to a mode for heating water to a set temperature within a shortest period of time by operating both the first heat exchanger and the second heat exchanger to the maximum extent. Specifically, the turbo mode 440 may correspond to a mode for heating water to a set temperature within a shortest period of time, rather than in consideration of energy efficiency, by operating the first heat exchanger and the second heat exchanger.

The vacation mode 450 may be a mode for maintaining water in the storage tank at a constant temperature when the water heater is not used, the mode in which an abnormal operation or freezing of the water heater at a low temperature is prevented. Specifically, the vacation mode 450 may be a mode that is set to maintain the water in the storage tank at a constant temperature in a case where the water heater is not used for more than a reference time, or may be a mode that is set to maintain the water in the storage tank at a constant temperature or higher in a case where a user selects the vacation mode 450. In this case, the temperature of the water may be maintained using the heater in a case where a temperature related to the outside of the water heater is below the first temperature, and the temperature of the water may be maintained using the heat pump system in a case where the temperature related to the outside of the water heater is equal to or above a predetermined temperature. For example, in a case where the user selects the vacation mode 450 with an outdoor temperature being equal to or above the first temperature, the water heater may operate the heat pump system to maintain the water in the storage tank at a constant temperature of 15° C.

Figure 5:
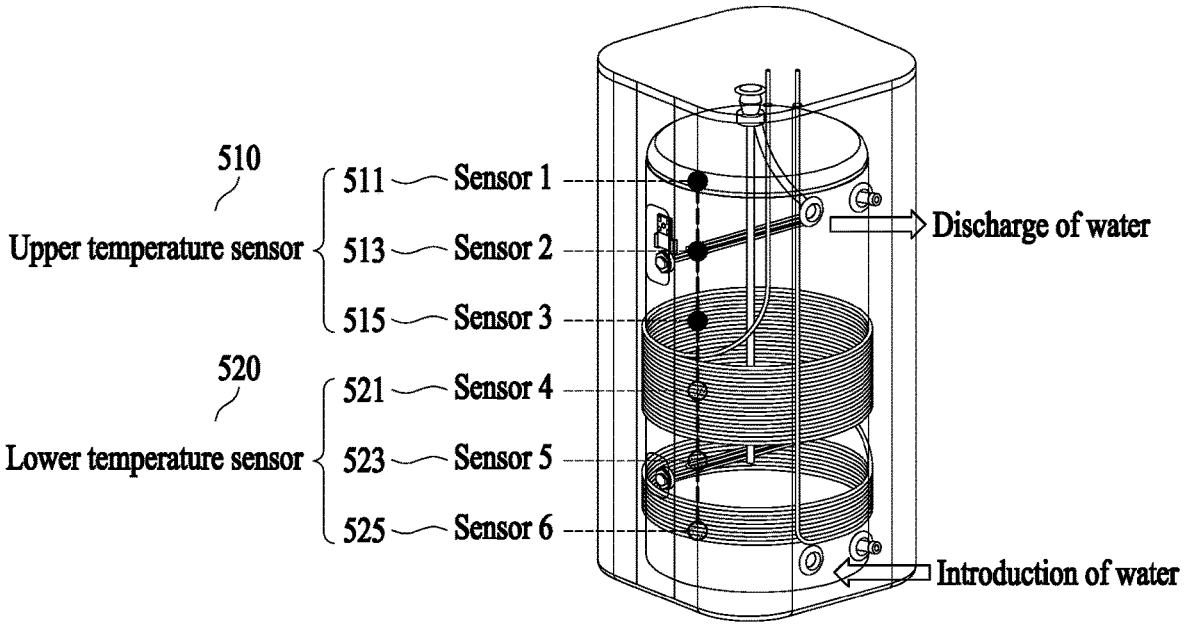
FIG. 5 is a diagram for explaining sensing a temperature of a predetermined region inside a storage tank according to an embodiment.

FIG. 5 is a diagram for explaining sensing a temperature of a predetermined region inside a storage tank according to an embodiment. An inside of the storage tank may be divided, for example, into six regions from the first region to the sixth region. In this case, the scope of the present disclosure is not limited to six regions as shown in FIG. 5, and may include the storage tank divided into a more or less number of regions.

Referring to FIG. 5, it is found that the upper heater is disposed in a second region and the lower heater is disposed in a fifth region. However, the scope of the present specification is not limited thereto. For example, unlike FIG. 5, a heater corresponding to a first region, a heater corresponding to a second region, and a heater corresponding to a third region may be included in the upper heater, and a heater corresponding to a fourth region, a heater corresponding to a fifth region, and a heater corresponding to a sixth region may be included in the lower heater. In another example, unlike FIG. 5, a heater corresponding to the first region and the second region and a heater corresponding to the second region and the third region may be included in the upper heater, and a heater corresponding to the fourth region and the fifth region and a heater corresponding to the fifth region and the sixth region may be included in the lower heater. In yet another example, four or more heaters may correspond to the first to third regions, and in this case four or more heaters may be included in the upper heater. In addition, four or more heaters may correspond to the fourth to sixth regions, and in this case four or more heaters may be included in the lower heater. Various positional relationships and various numbers of heaters may be included in the scope of the present specification.

The first temperature sensor may include a sensor corresponding to each region. For example, the first temperature sensor may include a sensor 1(511) corresponding to the first region, a sensor 2(513) corresponding to the second region, a sensor 3(515) corresponding to the third region, and a sensor 4(521) corresponding to the fourth region, a sensor 5(523) corresponding to the fifth region, and a sensor 6(525) corresponding to the sixth region.

The sensor 1(511) may sense a temperature of water corresponding to the first area, the sensor 2(513) may sense a temperature of water corresponding to the second area, the sensor 3(515) may sense a temperature of water corresponding to the third area, the sensor 4(521) may sense a temperature of water corresponding to the fourth region, the sensor 5(523) may sense a temperature of water corresponding to the fifth region, and the sensor 6(525) may sense a temperature of water corresponding to the sixth region.

The inside of the storage tank may be divided into an upper region and a lower region. The upper region may include a first region, a second region, and a third region, and the lower region may include a fourth region, a fifth region, and a sixth region. The lower region may correspond to a region close to the water inlet pipe, and the upper region may correspond to a region close to the water outlet pipe. In this case, the upper temperature sensor (510) may be a sensor for measuring a temperature of the upper region, and the lower temperature sensor (520) may be a sensor located below the upper temperature sensor (510) to measure a temperature of the lower region. In one example, the upper temperature sensor (510) may include the sensor 1(511), the sensor 2(513), and the sensor 3(515), and the lower temperature sensor (520) may include the sensor 4(521), the sensor 5(523), and the sensor 6(525).

The temperature of the upper region may be determined using at least one of the sensor 1(511), the sensor 2(513), and the sensor 3(515). Specifically, the temperature of the upper region may be determined by applying a weight to a temperature measured by a sensor for detecting a temperature of a region in which the water outlet pipe is located, compared with a temperature measured by other sensors. For example, in FIG. 5, the sensor for sensing the temperature of the region in which the water outlet pipe is located may be the sensor 2(513). Therefore, the temperature of the upper region may be determined by applying a weight to a temperature sensed by the sensor 2(513), compared with temperatures sensed by the sensor 1(511) and the sensor 3(515). In this case, the weight may be a statistical value predetermined through experiments.

In addition, the temperature of the lower region may be determined using at least one of the sensor 4(521), the sensor 5(523), and the sensor 6(525). Specifically, the temperature of the lower region may be determined by applying a weight to the temperature measured by the sensor for sensing the temperature of the region in which the water supply pipe is located, compared with a temperature sensed by any other sensor. For example, in FIG. 5, the sensor for sensing the temperature of the region in which the water inlet pipe is located may be sensor 6(525). Therefore, the temperature of the lower region may be determined by giving a weight to a temperature sensed by the sensor 6(525), compared with temperatures sensed by the sensors 4(521) and 5(523). In this case, the weight may be a statistical value predetermined through experiments.

Therefore, the water heater may sense a temperature of water stored in the storage tank using the first temperature sensor. Specifically, the water heater may sense a temperature of each region using the first temperature sensor, or may sense temperatures of the upper region and the lower region.

Figure 6:
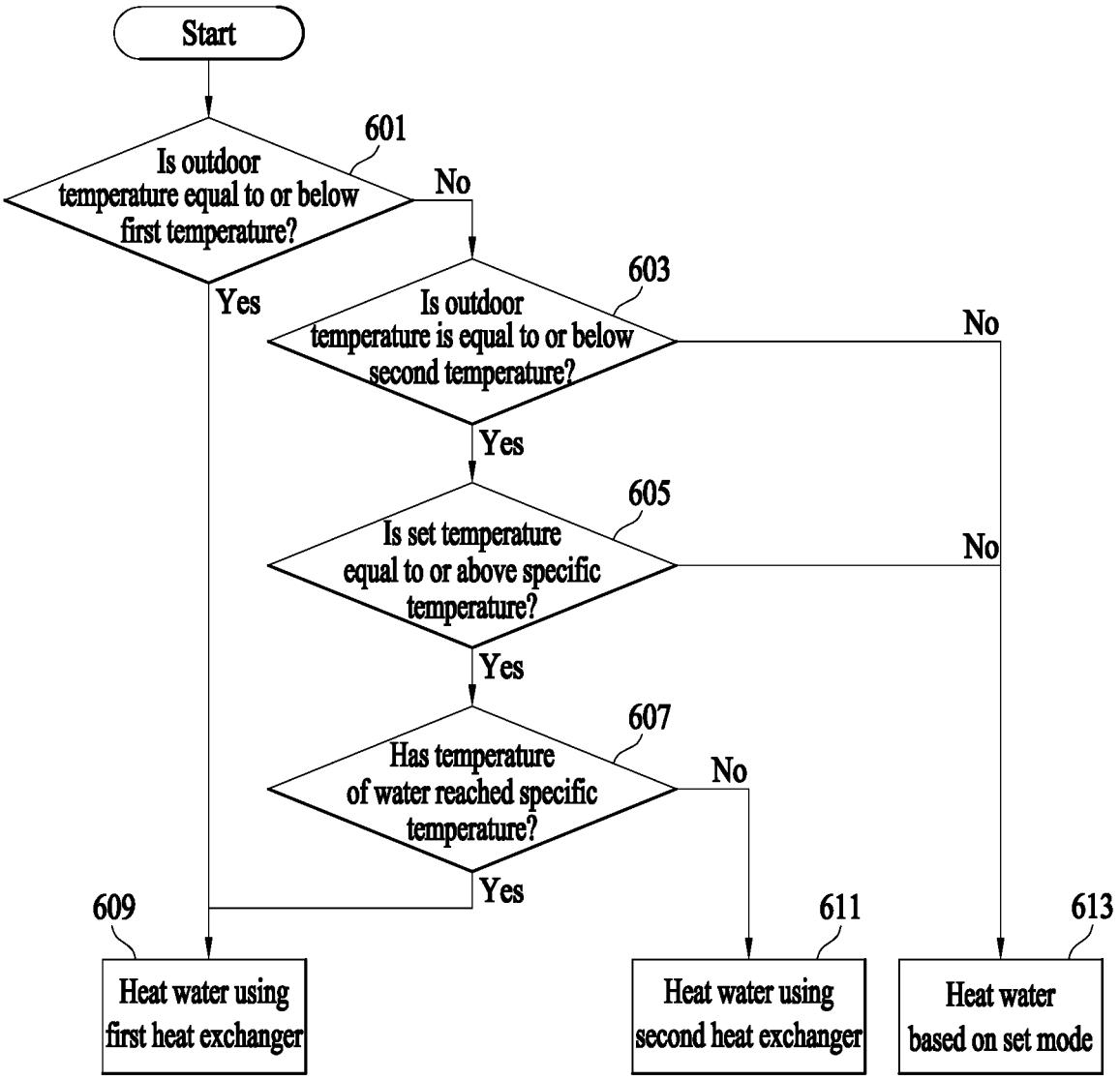
FIG. 6 is a diagram for explaining a process of controlling a water heater according to an embodiment.

FIG. 6 is a diagram for explaining a process of controlling a water heater according to an embodiment. In operation 601, the water heater may determine whether an outdoor temperature related to the outside of the water heater is equal to or below the first temperature. Specifically, the water heater may sense the outdoor temperature related to the outside of the water heater using the second temperature sensor. Here, the first temperature may be a value predetermined through experiments. For example, the water heater may determine whether the outdoor temperature related to the outside of the water heater is equal to or below −5° C.

In operation 609, in a case where the outdoor temperature is equal to or below the first temperature, the water heater may heat water using the first heat exchanger without operating the second heat exchanger, regardless of a mode. For example, in a case where the outdoor temperature is equal to or below −5° C., the water heater may heat water using the first heat exchanger, regardless of a mode. In this case, the water heater may heat water using the first heat exchanger without operating the second heat exchanger.

In operation 603, the water heater may determine whether the outdoor temperature is higher than the first temperature and equal to or below the second temperature. Here, the second temperature may be a value predetermined through experiments, for example, 5° C. In a case where the outdoor temperature is higher than the second temperature, the water heater may operate based on the set mode in operation 613. Regarding the modes, the above description is referred. For example, in a case where the outdoor temperature is higher than 5° C., the water heater may operate based on the set mode.

In operation 605, the water heater may determine whether the outdoor temperature is higher than the first temperature and equal to or below the second temperature, and whether the set temperature is equal to or above a specific temperature. In this case, the specific temperature is a preset value, for example, 50° C. For example, the water heater may determine whether the outdoor temperature is higher than −5° C. and equal to or below 5° C., and whether the set temperature is equal to or above 50° C. Using the water outlet pipe, the water heater may discharge water heated up to a set temperature. The set temperature may be set by the user or may be set based on a mode.

In operation 607, the water heater may determine whether a temperature of water in the storage tank reaches a specific temperature. For example, the water heater may determine whether the temperature of the water in the storage tank reaches 50° C.

In operation 609, the water heater may heat the water using the first heat exchanger. Specifically, in a case where the outdoor temperature is equal to or below the first temperature, the water heater may heat water using the first heat exchanger without operating the second heat exchanger, regardless of a mode. For example, in a case where the outdoor temperature is −10° C., the water heater may heat water using a heater, which is the first heat exchanger, without operating the second heat exchanger, regardless of a mode. Specifically, in a case where the outdoor temperature is −10° C., the water heater may heat the water using a heater, which is the first heat exchanger, without operating the second heat exchanger until the temperature of the water in the storage tank reaches the set water temperature. At this point, until a temperature value sensed by the upper temperature sensor reaches the set temperature, the heating operation may be performed using the upper heater without the operation of the lower heater. Alternatively, the water heater may first heat water corresponding to upper region of the storage tank using the first heat exchanger, before heating water corresponding to the lower region of the storage tank. At this point, in a case where the upper heater includes at least one heater, the controller may control operation of the at least one heater included in the upper heater in an order most adjacent to the water outlet pipe. For example, in a case where the upper heater includes three heaters, the controller may control operation of the three heaters included in the upper heater in an order most adjacent to the water outlet pipe. By first heating water adjacent to the outlet pipe, it is possible to provide a user with hot water more quickly.

In addition, in a case where the outdoor temperature is higher than the first temperature and equal to or below the second temperature and the set water temperature is equal to or above a specific temperature and a temperature of the water in the storage tank reaches the specific temperature, the water heater may heat the water in the storage tank to the set temperature using the first heat exchanger, regardless of a mode. For example, in a case where the outdoor temperature is 3° C. and the set water temperature is 60° C. and the temperature of the water in the storage tank reaches a specific temperature of 50° C., the water heater may heat water using the first heat exchanger without operating the second heat exchanger, regardless of a mode, until the temperature of the water reaches the set temperature of 60° C.

In operation 611, the water heater may heat the water using the second heat exchanger. Specifically, in a case where the outdoor temperature is higher than the first temperature and equal to or below the second temperature and the set water temperature is equal to or above a specific temperature, the water heater may heat the water using the second heat exchanger without operating the first heat exchanger, regardless of a mode, until a temperature of the water reaches the specific temperature. For example, in a case where the outdoor temperature is 3° C. and the set water temperature is 60° C. and the temperature of the water in the storage tank is 30° C., the water heater may heat the water using the second heat exchanger without operating the first heat exchanger, regardless of a mode, until the temperature of the water reaches a specific temperature of 50° C. In a case where the temperature of the water reaches the specific temperature of 50° C., the water heater may heat the water using the first heat exchanger without operating the second heat exchanger until the temperature of the water temperature reaches 60° C.

In operation 613, the water heater may operate based on a set mode. Specifically, in a case where the outdoor temperature is higher than the second temperature, the water heater may heat the water in the storage tank based on the set mode. In addition, in a case where the outdoor temperature is higher than the first temperature and equal to or below the second temperature and the set temperature of the water is below the specific temperature, the water heater may heat the water in the storage tank based on the set mode. For example, in a case where the outdoor temperature is 6° C., the water heater may heat the water in the storage tank based on the set mode. In addition, in a case where the outdoor temperature is 3° C. and the set water temperature is 40° C. below the specific temperature 50° C., the water heater may heat the water in the storage tank based on the set mode.

Figure 7:
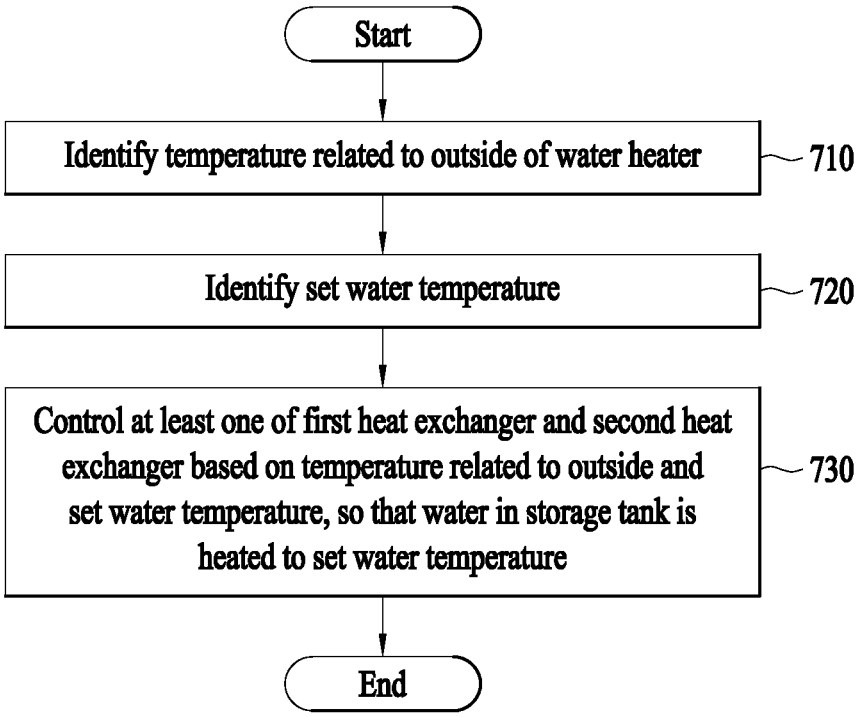
FIG. 7 is a diagram illustrating a control method of controlling a water heater according to an embodiment.

FIG. 7 is a diagram illustrating a control method of controlling a water heater according to an embodiment. The description described above with respect to the water heater may also be applied herein.

Referring to FIG. 7, in operation 710, the controller may identify a temperature related to the outside of the water heater. The water heater may include a sensor for measuring an outdoor temperature, the sensor may sense the outdoor temperature of the water heater, and the controller may identify the outdoor temperature sensed by the sensor.

In operation 720, the controller may identify a set temperature of the water. The water heater may heat the water in the storage tank to the set temperature and discharge the water heated to the set temperature. At this point, the set water temperature may be a value set by a user or a value automatically set in consideration of a surrounding environment.

In operation 730, the controller may control at least one of the first heat exchanger and the second heat exchanger based on the temperature related to the outside and the set temperature, so that the water in the storage tank is heated to the set temperature.

Specifically, in a case where the temperature related to the outside is equal to or below the first temperature, the water may be heated using the first heat exchanger without operating the second heat exchanger, regardless of a mode.

In addition, in a case where the temperature related to the outside is above the first temperature and equal to or below the second temperature and the set temperature of the water is equal to or above a specific temperature, the second heat exchanger may first perform a heating operation and then the first heat exchanger may perform a heating operation. Specifically, the controller may perform a control to heat the water in the storage using the second heat exchanger without operating the first heat exchanger until the temperature of the water in the storage tank reaches the specific temperature. In addition, the controller may heat the water using the first heat exchanger without operating the second heat exchanger until the temperature of the water in the storage tank reaches a set temperature after the temperature of the water in the storage water reaches the specific temperature.

In addition, in a case where the temperature related to the outside is above the second temperature, the controller may control the water heater to heat the water based on a set mode. Alternatively, in a case where the temperature related to the outside is above the first temperature and equal to or below the second temperature and the set temperature of the water is below the specific temperature, the controller may control the water heater to heat the water based on the set mode. The mode of the water heater may include at least one of an auto mode, a turbo mode, a heater mode, a heat pump mode, and a vacation mode.

According to the exemplary embodiment of the present specification, there are one or more effects as below.

First, it is possible to provide hot water efficiently in consideration of heating performance by controlling at least one of the first heat exchanger and the second heat exchanger in consideration of an outdoor temperature and a set water temperature.

Second, it is possible to improve efficiency of the water heater by controlling at least one of the first heat exchanger and the second heat exchanger in consideration of an outdoor temperature that significantly degrades heating performance of the water heater.

Third, it is possible to provide hot water by comparing a set water temperature and a specific temperature and controlling at least one of the first heat exchanger and the second heat exchanger, regardless of a mode.

Effects of the present disclosure may not be limited to the above and other objects and other objects which are not described may be clearly comprehended to those of skill in the art to which the embodiment pertains through the claims.

Meanwhile, the present disclosure and drawings have been described with reference to some example embodiments. Although specific terms are used, it is only used in a general sense to easily explain the technical details of the present disclosure and help the understanding of the invention, and it is not intended to limit the scope of the present disclosure. It will be apparent to those skilled in the art that other modifications based on the technical idea of the present disclosure can be carried out in addition to the embodiments disclosed herein.

It will be understood that each block of flowcharts and/or block diagrams, and combinations of blocks in flowcharts and/or block diagrams, can be implemented by computer program instructions. These computer program instructions may be provided to a processor of a general-purpose computer, special purpose computer, or other programmable data processing apparatus, such that the instructions which are executed via the processor of the computer or other programmable data processing apparatus create means for implementing the functions/acts specified in the flowcharts and/or block diagrams. These computer program instructions may also be stored in a non-transitory computer-readable memory that can direct a computer or other programmable data processing apparatus to function in a particular manner, such that the instructions stored in the non-transitory computer-readable memory produce articles of manufacture embedding instruction means which implement the function/act specified in the flowcharts and/or block diagrams. The computer program instructions may also be loaded onto a computer or other programmable data processing apparatus to cause a series of operational steps to be performed on the computer or other programmable apparatus to produce a computer implemented process such that the instructions which are executed on the computer or other programmable apparatus provide steps for implementing the functions/acts specified in the flowcharts and/or block diagrams.

Furthermore, the respective block diagrams may illustrate parts of modules, segments, or codes including at least one or more executable instructions for performing specific logic function(s). Moreover, it should be noted that the functions of the blocks may be performed in a different order in several modifications. For example, two successive blocks may be performed substantially at the same time, or may be performed in reverse order according to their functions. According to various embodiments of the present disclosure, the term "module", means, but is not limited to, a software or hardware component, such as a Field Programmable Gate Array (FPGA) or Application Specific Integrated Circuit (ASIC), which performs certain tasks. A module may advantageously be configured to reside on the addressable storage medium and be configured to be executed on one or more processors. Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and modules may be combined into fewer components and modules or further separated into additional components and modules. In addition, the components and modules may be implemented such that they execute one or more CPUs in a device or a secure multimedia card. In addition, a controller mentioned in the embodiments may include at least one processor that is operated to control a corresponding apparatus.

The present specification has been proposed in an effort to solve the above-mentioned problem and aims to provide a water heater for controlling at least one of a first heat exchanger and a second heat exchanger based on an outdoor temperature and a set water temperature.

In an aspect of the present disclosure, a water heater controls at least one of a first heat exchanger and a second heat exchanger in consideration of a problem caused by deterioration of heating performance when an outdoor temperature is low.

However, the technical object of the present disclosure is not limited thereto, and other technical objects may be inferred from the following embodiments.

According to an aspect, there is provided a water heater including a storage tank configured to store water, at least one first temperature sensor configured to sense a temperature of the water stored in the storage tank, a second temperature sensor configured to sense a temperature related to an outside of the water heater, a first heat exchanger comprising at least one heating element configured to heat the water, a second heat exchanger comprising a heat pump system and configured to heat the water, and a controller configured to control at least one of the first heat exchanger and the second heat exchanger based on the temperature sensed by the second temperature sensor and a set water temperature.

The controller may be configured to heat the water using the first heat exchanger without operating the second heat exchanger in a case where the temperature sensed by the second temperature sensor is equal to or below a first temperature.

The controller may be configured to control the first heat exchanger to perform a heating operation after the second heat exchanger performs a heating operation in a case where the temperature sensed by the second temperature sensor is above a first temperature and equal to or below a second temperature and the set water temperature is equal to or above a specific temperature.

The first heat exchanger may be configured to start a heating operation based on the temperature sensed by the at least one first temperature sensor.

The controller may be configured to heat the water using the second heat exchanger without operating the first heat exchanger until the temperature sensed by the at least one first temperature sensor reaches the specific temperature.

The controller may be configured to heat the water using the first heat exchanger without operating the second heat exchanger until the temperature sensed by the at least one first temperature sensor reaches the set water temperature in a case where the temperature sensed by the at least one first temperature sensor is equal to or above the specific temperature.

The controller may be configured to heat the water based on a set mode in a case where the temperature sensed by the second temperature sensor is above a second temperature, or heat the water based on the set mode in a case where the temperature sensed by the second temperature sensor is above a first temperature and equal to or below the second temperature and the set water temperature is below a specific temperature.

The at least one first temperature sensor may include an upper temperature sensor disposed in an upper region of the storage tank and a lower temperature sensor disposed below the upper temperature sensor. The first heat exchanger may include an upper heater disposed in the upper region and a lower heater disposed below the upper heater. The controller may be configured to perform a heating operation using the upper heater without operating the lower heater until a temperature value sensed by the upper temperature sensor reaches the set water temperature in a case where the temperature sensed by the second temperature sensor is equal to or below a first temperature.

The upper heater may include a plurality of heaters, and the controller may be configured to control operations of the plurality of heaters included in the upper heater in an order most adjacent to a water outlet pipe.

The upper heater may include a plurality of heaters, and the controller may be configured to first heat a temperature of water corresponding to an upper region of the storage tank using the first heat exchanger before a temperature of water corresponding to a lower region of the storage tank.

The water heater may be configured to operate based on at least one of a heat pump mode, a heater mode, an auto mode, a turbo mode, and a vacation mode.

According to an aspect, there is provided a control method of a water heater, the method including identifying a temperature related to an outside of the water heater, identifying a set water temperature, and controlling at least one of a first heat exchanger and a second heat exchanger based on a temperature related to an outside and the set water temperature, so that the water in the storage tank is heated to the set water temperature.

Specific details of other embodiments are included in the detailed description and the drawings.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A water heater comprising:

a storage tank configured to store water;

a plurality of first temperature sensors including a plurality of upper temperature sensors and a plurality of lower temperature sensors below the upper temperature sensors configured to sense a temperature of the water in the storage tank, wherein the plurality of upper temperature sensors are disposed in an upper region of the storage tank and the plurality of lower temperature sensors are disposed in a lower region of the storage tank below the upper region of the storage tank;

a second temperature sensor configured to sense a temperature outside of the water heater;

a first heat exchanger corresponding to a plurality of heaters disposed in the storage tank configured to heat the water;

a second heat exchanger corresponding to a heat pump system configured to heat the water; and a controller configured to heat the water by controlling at least one of the first heat exchanger or the second heat exchanger based on the temperature sensed by the second temperature sensor and a set water temperature, wherein different weights are applied to the plurality of upper temperature sensors considering an order adjacent to a water outlet pipe among the plurality of upper temperature sensors, and the temperature of the water in the storage tank is determined in consideration of the weight different weights, wherein the plurality of heaters are provided in an order from an upper heater to a lower heater, the upper heater is disposed in the upper region of the storage tank, and the lower heater is disposed in the lower region of storage tank, wherein the controller, until the temperature sensed by the plurality of first temperature sensors reaches the set water temperature when the temperature sensed by the second temperature sensor is determined to be equal to or less than a first temperature, is configured to control operation of the upper heater without operating the lower heater.

2. The water heater of claim 1, wherein the controller is configured to:

determine that the temperature sensed by the second temperature sensor is equal to or less than the first temperature, and control the first heat exchanger to heat the water without operating the second heat exchanger when the temperature sensed by the second temperature sensor is determined to be equal to or less than the first temperature.

3. The water heater of claim 1, wherein the controller is configured to:

determine that the temperature sensed by the second temperature sensor is greater than the first temperature and equal to or less than a second temperature;

determine that the set water temperature is equal to or greater than a specific temperature; and control the first heat exchanger to perform a heating operation after the second heat exchanger performs a heating operation when the temperature sensed by the second temperature sensor is determined to be greater than the first temperature and equal to or less than the second temperature and the set water temperature is determined to be equal to or greater than the specific temperature.

4. The water heater of claim 3, wherein the controller is configured to control the second heat exchange to heat the water without operating the first heat exchanger until the temperature sensed by the plurality of first temperature sensors is determined to have reached the specific temperature.

5. The water heater of claim 3, wherein the controller is configured to:

determine that the temperature sensed by the plurality of first temperature sensors is equal to or greater than the specific temperature; and control the first heat exchanger to heat the water without operating the second heat exchanger until the temperature sensed by the plurality of first temperature sensors reaches the set water temperature when the temperature sensed by the plurality of first temperature sensors is determined to be equal to or greater than the specific temperature.

6. The water heater of claim 1, wherein the controller is configured to:

determine that the temperature sensed by the second temperature sensor is greater than a second temperature; and heat the water based on a set mode when the temperature sensed by the second temperature sensor is determined to be greater than the second temperature.

7. The water heater of claim 1, wherein the controller is configured to:

determine that the temperature sensed by the second temperature sensor is greater than the first temperature and equal to or less than the second temperature;

determine that the set water temperature is less than a specific temperature; and heat the water based on a set mode when the temperature sensed by the second temperature sensor is determined to be greater than the first temperature and equal to or less than the second temperature and the set water temperature is determined to be less than the specific temperature.

8. The water heater of claim 1, wherein:

the controller is configured to:

determine that the temperature sensed by the second temperature sensor is equal to or less than the first temperature.

9. The water heater of claim 1, wherein the water heater is configured to operate based on at least one of a heat pump mode, a heater mode, an auto mode, a turbo mode, or a vacation mode.

10. A method of operating a water heater, the method comprising:

determining an outside temperature of the water heater;

determining a set water temperature; and controlling at least one of a first heat exchanger or a second heat exchanger based on the determined outside temperature and the determined set water temperature such that water in a storage tank is heated to the set water temperature, wherein the first heat exchanger corresponds to a plurality of heaters disposed in the storage tank, and the second heat exchanger corresponds to a heat pump system, wherein a temperature of the water in the storage tank is configured to be sensed by a plurality of first temperature sensors, wherein the plurality of first temperature sensors including a plurality of upper temperature sensors and a plurality of lower temperature sensors below the upper temperature sensors configured to sense a temperature of the water in the storage tank, wherein the plurality of upper temperature sensors are disposed in an upper region of the storage tank and the plurality of lower temperature sensors are disposed in a lower region of the storage tank below the upper region of the storage tank, wherein a temperature outside of the water heater is configured to be sensed by a second temperature sensor, wherein different weights are applied to the plurality of upper temperature sensors considering an order adjacent to a water outlet pipe among the plurality of upper temperature sensors, and the temperature of the water in the storage tank is determined in consideration of the different weights, wherein the plurality of heaters are provided in an order from an upper heater to a lower heater, the upper heater is disposed in the upper region of the storage tank, and the lower heater is disposed in the lower region of the storage tank, wherein the controlling comprises controlling operation of the upper heater without operating the lower heater, until the temperature sensed by the plurality of first temperature sensors reaches the set water temperature when the temperature sensed by the second temperature sensor is determined to be equal to or less than a first temperature.

11. The method of claim 10, wherein the controlling comprises controlling the first heat exchanger to heat the water without operating the second heat exchanger when the outside temperature is equal to or less than the first temperature.

12. The method of claim 10, wherein the controlling comprises controlling the first heat exchanger to perform a heating operation after the second heat exchanger performs a heating operation when the outside temperature is greater than the first temperature and equal to or less than a second temperature and the set water temperature is equal to or greater than a specific temperature.

13. The method of claim 12, wherein the controlling comprises controlling the second heat exchanger to heat the water without operating the first heat exchanger until the temperature of the water in the storage tank reaches the specific temperature.

14. The method of claim 12, wherein the controlling comprises when the temperature of the water in the storage tank is equal to or greater than the specific temperature, controlling the first heat exchanger to heat the water without operating the second heat exchanger until the temperature of the water in the storage tank reaches the set water temperature.

15. The method of claim 10, wherein the controlling comprises:

heating the water based on a set mode when the outside temperature is greater than a second temperature.

16. The method of claim 10, wherein the controlling comprises:

heating the water based on a set mode when the outside temperature is greater than the first temperature and equal to or less than a second temperature and the set water temperature is less than a specific temperature.

* * * * *